United States Patent [19]

Vydrin et al.

[11] 4,087,999

[45] May 9, 1978

[54] DEVICE FOR AUTOMATIC ADJUSTMENT OF ROLL GAP IN MILL STAND

[76] Inventors: Vladimir Nikolaevich Vydrin, ulitsa Timiryazeva 28, kv. 27; Vladimir Georgievich Dukmasov, ulitsa Soni Krivoi 77, kv. 5; Garifulla Davlyatshin, Komsomolsky prospekt 15, kv. 100, all of Chelyabinsk, U.S.S.R.

[21] Appl. No.: 755,039

[22] Filed: Dec. 28, 1976

[51] Int. Cl.[2] ..... B21B 31/32
[52] U.S. Cl. ..... 72/245
[58] Field of Search ..... 72/245, 237, 21, 19, 72/20, 6, 8

[56] References Cited

U.S. PATENT DOCUMENTS

| | | | |
|---|---|---|---|
| 3,327,508 | 6/1967 | Brown | 72/6 |
| 3,427,839 | 2/1969 | Neumann | 72/20 |
| 3,733,870 | 5/1973 | Diolot | 72/245 |

*Primary Examiner*—Milton S. Mehr
*Attorney, Agent, or Firm*—Lackenbach, Lilling & Siegel

[57] ABSTRACT

A device for automatic adjustment of a roll gap in a mill stand, comprises hollow hydraulic load cells for absorbing or taking up a roll force. Said hydraulic load cells are mounted under chocks of at least one of the rolls and are not affected by the action of hydraulic cylinders adapted to develop a stand prestressing force. The hydraulic cylinders are of the two-chamber type. One of the chambers of each hydraulic cylinder communicates directly with that of the hydraulic load cell, while the other chamber communicates directly with a constant-pressure fluid source.

2 Claims, 4 Drawing Figures

DEVICE FOR AUTOMATIC ADJUSTMENT OF ROLL GAP IN MILL STAND

The present invention relates to rolling-mill equipment, and, more particularly, to a device for automatic adjustment of a roll gap in a mill stand.

The present invention may prove to be most advantageous in sheet and strip rolling mills.

Known in the art is a device, for automatic adjustment of a roll gap in a mill stand, comprising single-chamber hydraulic cylinders adapted for prestressing said stand and set up under bottom roll chocks.

The hydraulic cylinders are equipped with an electrohydraulic system for controlling the pressure of a working medium fed into said hydraulic cylinders from a high-pressure working medium (fluid) source.

Said electrohydraulic system comprises electric load cells to absorb a roll force, cells for recording a prestressing force and servo-operated valves with their electric control system.

The electric load cells for absorbing the roll force are installed under stand housing screws on the top roll chocks.

The electric load cells for recording the prestressing force are installed between a top-housing separator and the bottom roll chocks.

Both the servo-operated valves with their electric control system and the high-pressure fluid source are disposed externally of the mill stand.

The device for automatic adjustment of the roll gap in a mill stand operates in the following manner.

While rolling a strip, the roll force is varied and adjusted with the help of the electric load cell. A signal issued by this load cell is received by the electrohydraulic system for fluid pressure control of the hydraulic cylinders. By this signal the servo-operated valve is operated to alter the fluid pressure in the hydraulic cylinders and, hence, the stand prestressing force. It is the prescribed alteration of the stand prestressing force in accordance with the roll force that assures automatic adjustment of the mill roll gap within a preset range.

The prior-art device allows a sufficiently accurate adjusting of the roll gap.

However, the servo-operated valves require a highly purified fluid (oil), otherwise their operation becomes unstable which reduces the operating dependability of the device.

Moreover, the servo-operated valves are very sophisticated in terms of their design, their cost is high and their servicing, as well as that of their electric control system, requires highly skilled personnel.

Inventor's Certificate of the USSR Pat. No. 452,380 discloses a device for automatic adjusting of a roll gap in a mill stand, comprising hydraulic load cells for absorbing a roll force, said load cells being installed under the chocks of one the rolls and being unaffected by the action of single-chamber hydraulic cylinders adapted for prestressing the stand.

Each single-chamber hydraulic cylinder for each stand side individually communicates with a chamber of a three-chamber pressure controller. The central chamber of this three-space pressure controller is made to communicate through a cut-in spool valve with a hydraulic dynamometer, the third chamber of the three-chamber pressure controller being in communication with a constant-pressure fluid source.

The aforesaid device functions in the following manner.

As a strip is being rolled between the mill rolls, the variable roll force changes the fluid pressure in the hydraulic load cells, the pressure in the central chambers of the three-chamber pressure controllers being varied accordingly with the ensuing shifting of the spool valves of the three-chamber pressure controllers. As a result of the shifting of the three-chamber pressure controller spool valves, the fluid pressure in the hydraulic cylinders and, consequently, the stand prestressing force will change.

Device parameters are preselected so as to provide automatic adjusting of the mill roll gap by varying the stand prestressing force in accordance with the roll force. A control range is determined by the prescribed pressure level in the constant-pressure working fluid source and by adjustment of the cut-in spool valve.

This device is capable of realizing a sufficiently accurate control of the stand roll gap.

However, the three-chamber pressure controller is highly responsive to a fluid purifying degree, its operation in case of contaminated oil becoming unstable which adversely affects the dependability of said device.

Moreover, the provision of the three-chamber pressure controller adds to the overall dimensions of the device for automatic roll gap adjustment in a mill stand.

The main object of the present invention is to provide a device for automatic adjustment of a roll gap in a mill stand featuring a simple design, low manufacturing cost and high operating dependability.

Another important object of the invention is to provide a device for automatic adjustment of a roll gap in a mill stand which enables the use of a fluid with a purifying degree characteristic of that employed in conventional hydraulic drives.

Still another object of the invention is to provide a device for automatic adjustment of a roll gap in a mill stand which can be serviced by attendants having no special skill.

These and other objects are achieved by providing a device for automatic adjustment of a roll gap in a mill stand comprising hydraulic load cells for absorbing a roll force, dynamometers being mounted under chocks of at least one of the mill rolls and being unaffected by the action of hydraulic cylinders adapted to develop a stand prestressing force, and communicating with a hydraulic load cell chamber and a constant-pressure fluid source. According to the invention, each hydraulic cylinder has two chambers, one of these being in direct communication with that of the hydraulic load cell, while the other communicates directly with said constant-pressure fluid source.

In the device of the invention a change in the roll force alters the fluid pressure in the hydraulic load cell and at the same time the fluid pressure in the hydraulic cylinder chamber being in direct communication therewith.

This in turn results in a change in the stand prestressing force developed by connecting the other hydraulic cylinder chamber to the constant-pressure working fluid source.

Thus, a proper selection of the hydraulic load cell parameters causes, like in the prior-art devices, a prescribed variation in the stand prestressing force depending on the roll force and, hence, provides for an automatic adjustment of the stand roll gap.

Moreover, the device is based on the use of hydraulic cylinders and dynamometers with a fluid of the same purifying degree as that employed in conventional hydraulic drives.

According to the present invention, the proposed device, which is characterized by simplicity of design, low manufacturing cost and simple servicing, does not require highly skilled attendants and features, consequently, a higher operating dependability.

It is expedient that each two-chamber hydraulic cylinder be provided with two rods, one of these resting on a mill separator, while the other one accommodates the hydraulic load cell. The roll chock resting on the hydraulic load cell is fitted with openings for bars to pass therethrough, said bars having their respective ends thrusting against the body of the two-chamber hydraulic cylinder and the second roll chock.

The aforedescribed structure of the two-chamber hydraulic cylinders provides for connection of one of the chambers of each hydraulic cylinder to the respective hydraulic load cell through the openings in the hydraulic cylinder rods, this rendering the proposed device even simpler.

Moreover, the design of the two-chamber hydraulic cylinders as set forth above makes it possible to replace the mill roll without removing the two-chamber hydraulic cylinders and detaching said roll from the constant-pressure fluid source. All these factors make the attendance of the above device even simpler.

It is advisable that each two-chamber hydraulic cylinder be fitted with two rods, of which one is resting on the mill separator, whereas the other one accommodates the hydraulic load cell. The chocks of both rolls have openings for the bars to pass therethrough, the bars striking with their ends against the body of the two-chamber hydraulic cylinder and an opposite mill separator.

As a result, the roll gap adjustment with the help of a screw-down gear does not affect the fluid pressure in the hydraulic load cell chamber or in that of the hydraulic cylinder in communication therewith. The adjustment can be, therefore, effected while rolling a strip between the rolls, a feature which simplifies the attendance of the proposed device.

It is desirable for each bar to be made up of a plurality of parts abutted against each other.

This simplifies roll-changing in the mill stand.

It is good practice that the chamber of the two-chamber hydraulic cylinder in communication with that of the hydraulic load cell be made to communicate with an appliance for varying the pressure within said spaces.

This will make it possible to adjust the device parameters at a change in stand rigidity, simplifying thereby the servicing of the proposed device.

Thus, the herein-proposed device for automatic adjustment of a roll gap in a mill stand is characterized by simplicity of design and low manufacturing cost, uses a fluid with a purifying degree peculiar to that employed in conventional hydraulic drives, thus is simple in servicing and does not require highly-skilled attandants, providing a higher operating dependability.

The nature of the invention will be clear from the following detailed description of embodiments thereof, taken in conjunction with the accompanying drawings, in which.

Figure 3:
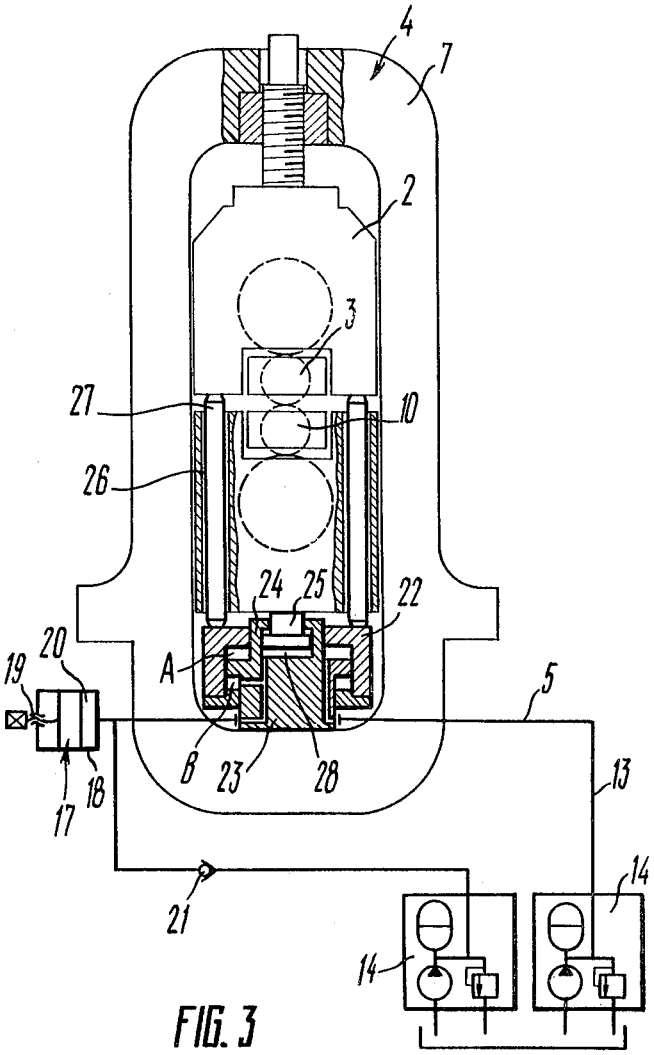
Figure 4:
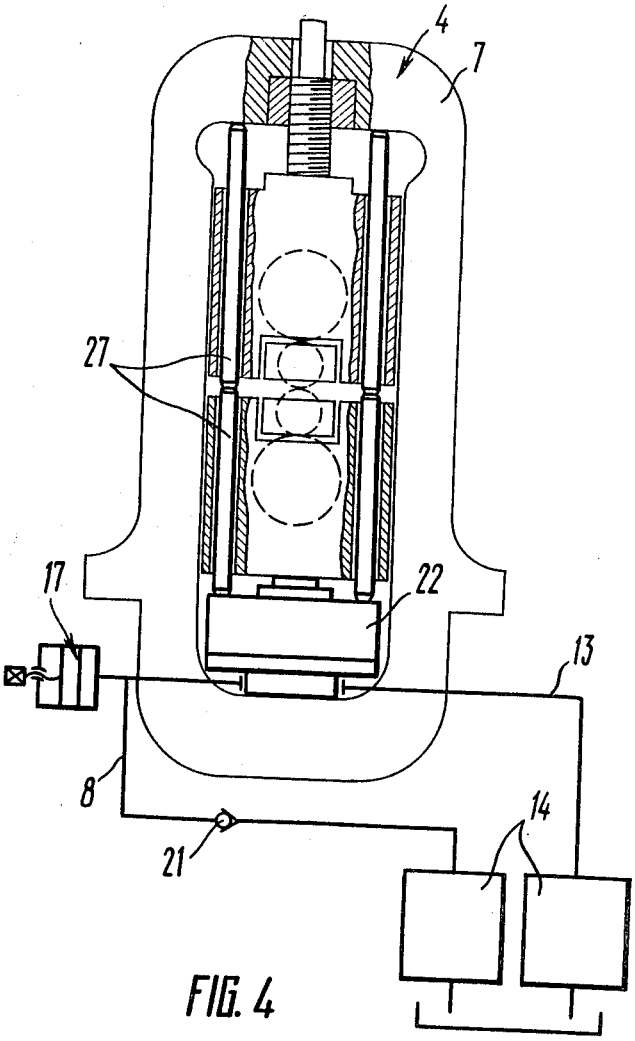

FIG. 3 is a general view (partly in section) of a device for automatic adjustment of a roll gap in a mill stand, wherein, according to the invention, a hydraulic cylinder is fitted with two rods, one of which rests on a mill separator, while the other one accommodates a hydraulic load cell, the roll chock resting on the hydraulic load cell having openings for the bars to pass therethrough, said bars having their respective ends thrust against the body of a two-chamber hydraulic cylinder and the second roll chock; and FIG. 4 is a general view (partly in section) of a device for automatic adjustment of a roll gap in a mill stand, according to the invention, with the bars extending through the openings in the chocks of both rolls, said bars being subdivided into parts abutted against each other.

Figure 1:
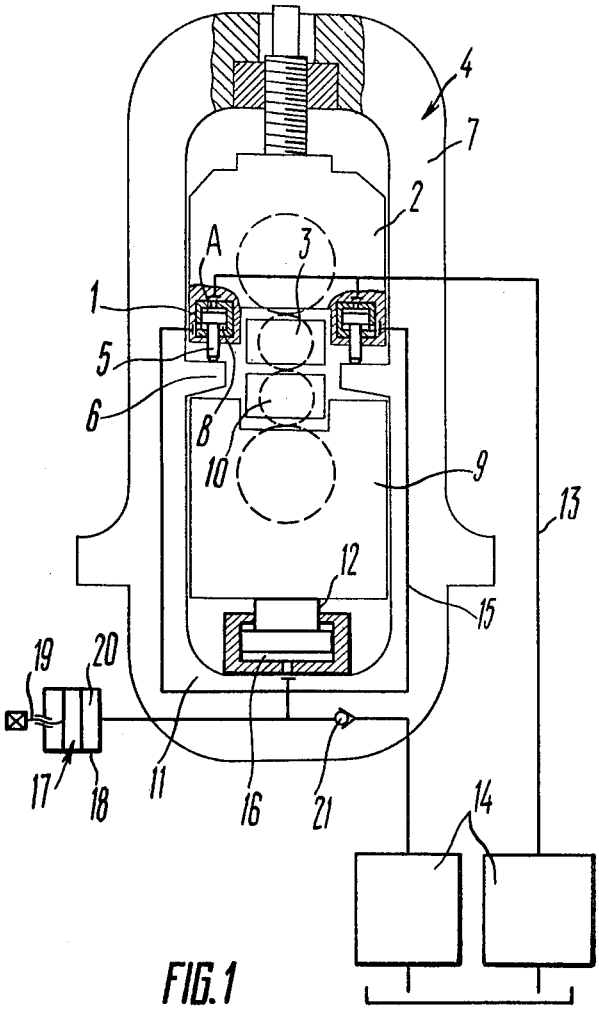
FIG. 1 is a general view (partly in section) of a device for automatic adjustment of a roll gap in a mill stand, according to the invention.

The device of the present invention for automatic adjustment of a roll gap in a rolling mill stand (for one side of said stand) comprises two-chamber hydraulic cylinders 1 (FIG. 1) arranged in chocks 2 of a top roll 3 and developing a force for prestressing a stand 4 of a rolling mill (not shown in the drawing).

Rods 5 of said hydraulic cylinders 1 bear up against projections 6 of a housing 7 of the stand 4.

Figure 2:
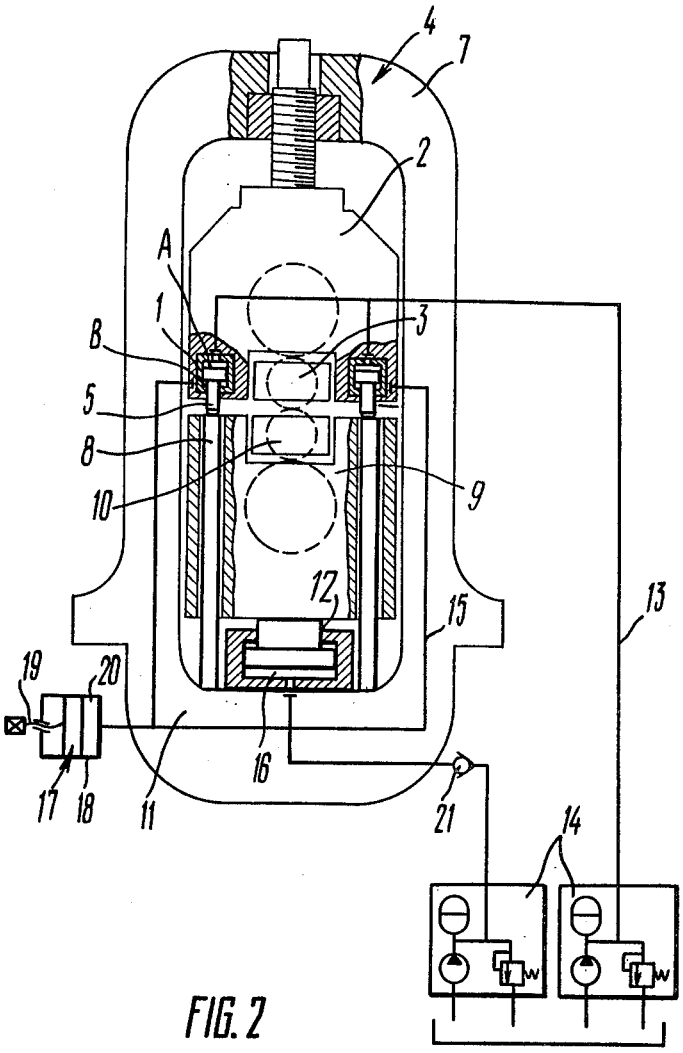
FIG. 2 is a general view (partly in section) of a device for automatic adjustment of a roll gap in a mill stand, according to the present invention, with bars extending through openings in a bottom roll chock.

In an alternate embodiment, said rods 5 (FIG. 2) can rest on bars 8 passed through openings in chocks 9 of a bottom roll 10. The bars 8 could also rest on a bottom separator 11 of the housing 7 of the stand 4. This simplifies the replacement of the backup rolls 3 and 10 in the mill stand 4.

Mounted under the chocks 9 (FIG. 1) of the bottom roll 10 is a hydraulic load cell, piston or the like 12 which takes up or absorbs a roll force and is not affected by the prestressing force of the stand 4.

Chamber "A" of each two-chamber hydraulic cylinder 1 communicates through pipes 13 directly with a constant-pressure fluid source 14 (such as a pump-and-accumulator plant).

Chamber "B" of each two-chamber hydraulic cylinder 1 communicates through pipe lines 15 (flexible or movable) directly with a chamber 16 of the hydraulic load cell 12. Moreover, the chamber "B" of each two-chamber hydraulic cylinder 1 is in communication with an appliance 17 for varying the pressure of the chambers "B" of the two-chamber hydraulic cylinders 1 and of the chambers 16 of the hydraulic load cell 12.

The appliance 17 can be made as a cylinder 18 with a screw rod 19.

The chambers "B" of the two-chamber hydraulic cylinders 1, the chambers 16 of the hydraulic load cells 12 and the chambers 20 of the cylinder 18 with the screw rod 19 communicate with the constant-pressure fluid source 14 through a non-return valve 21.

The herein-proposed device for automatic adjustment of a roll gap in a mill stand operates in the following manner.

In its initial position (when there is no metal between the mill rolls), the fluid, which is at a preset constant pressure $q_o$) flows from the pump-and-accumulator plant 14 into the chambers "A" of the two-chamber hydraulic cylinders 1.

The chambers 16 of the hydraulic dynamometers 12 and the chambers "B" of the two-chamber hydraulic cylinders 1 are filled with fluid that is fed at a pressure $q$ from the pump-and-accumulator plant 14.

As a result, the housing 7 of the stand 4 with the screw-down gear takes up a prestressing force $N_o$ of the stand 4 developed by the two-chamber hydraulic cylinders 1:

$$N_o = q_o F_{"A"} - q F_{"B"}, \quad (1)$$

where $F_{"A"}$ and $F_{"B"}$ are the areas of the chambers "A" and "B" of the appropriate two-chamber hydraulic cylinders 1.

Said prestressing force does not act on the chocks resting on the hydraulic dynamometers or work cells 12, insofar as the rods of the two-chamber hydraulic cylinders 1 thrust against the housing 7.

During the rolling operation the hydraulic load cells 12 absorb a roll force P with an ensuing increase in the fluid pressure therein.

Owing to this rise in pressure the non-return valves 21 cut off the chambers 16 of the hydraulic load cells 12 and the chambers "B" of the two-chamber hydraulic cylinders 1 from the pump-and-accumulator plant 14.

As a result separate closed systems hydraulic load cell 12 and chamber "B" of two-chamber hydraulic cylinder 1, are formed for the left- and right-hand sides of the stand 4.

Under the effect of the roll force P the prestressing force of the mill stand 4 changes and becomes equal to N:

$$N = q_o F_{"A"} - q_1 F_{"B"}, \quad (2)$$

where $q_1 = P/F_1$ is the fluid pressure in the hydraulic load cell 12 and in the chambers "B" of the two-chamber hydraulic cylinders 1 when a strip is being rolled; and $F_1$ is the area of the chamber 16 of the hydraulic load cell 12.

Fluctuations of the roll force causes a rise (or a drop) in the fluid pressure within the closed systems hydraulic load cell 12 and chambers "B" of two-chamber hydraulic cylinders 1. In this case the stand prestressing force will diminish (or increase) accordingly.

At a prescribed ratio between the fluctuations of the roll force and that of the prestressing force of the stand 4, the roll gap of the stand 4 is adjusted within a preset range.

It can be proved by corresponding calculations.

The housing with the screw-down gear is loaded by a total force equal to:

$$T = P + N \quad (3)$$

Substituting the value of N from the equation (2) into the equation (3) and upon making the requisite transformations we obtain $$T = \left(1 - \frac{F_{"B"}}{F_1}\right)P + q_o F_{"A"} \quad (4)$$

As is seen from equation (4), if $$1 - \frac{F_{"B"}}{F_1} > 0,$$

then when $q_o F_{"A"}$ = const, an increase (or decrease) in the roll force causes the total force T and, hence, the roll gap to become greater. If $$1 - \frac{F_{"B"}}{F_1} = 0,$$

then at any roll force the total force $T = q_o F_{"A"}$, and at $q_o$ = const, said force T is constant and, hence, elastic expansion of the mill housing together with the screw-down gear will not vary. In this case a change in the stand expansion can result only from that of the rolls.

If $$1 - \frac{F_{"B"}}{F_1} < 0,$$

then an increase in the roll force will cause a decrease in the total force T and vice versa.

Thus, it is possible to select such a relation $F_{"B"}/F_1$ at which a change in the roll gap under the effect of the roll force P will be offset by a decrease in elastic expansion of the housing with the screw-down gear under the effect of the total force T.

Hence, the requisite mode of automatic roll gap adjustment is prescribed by the ratio $F_{"B"}/F_1$.

To change the operating conditions of the proposed device at a prescribed ratio $F_{"B"}/F_1$ use is made of the appliance 17 which varies the pressure within the chambers, the appliance 17 being made as the cylinder 18 with the screw rod 19.

The appliance 17 makes it possible to change within a requisite range the amount of the fluid in the closed system "chambers "B" of the two-chamber hydraulic cylinders 1 — hydraulic dynamometer 12."

At a change in the amount of fluid flowing in this closed system, the pressure within the chamber 16 of the hydraulic load cell 12, as well as that in the chambers "B" of the hydraulic cylinders 1, will change with the ensuing appropriate change in the operating conditions of the proposed device.

It is illustrated hereinbelow in the following manner.

In the general case the following equality holds true for a prestressed mill stand:

$$\frac{\Delta N}{C} + \frac{\Delta P}{C} + \frac{\Delta P}{C_r} = \Delta h, \quad (5)$$

where

- $\Delta N$ is an algebraic value of a change in the prestressing force of the stand 4;
- $\Delta P$ is an algebraic value of a change in the roll force;
- $\Delta h$ is a change in the roll gap;
- C and $C_r$ are respectively the rigidity values of the stand 4 without rolls and of the rolls proper.

If $\Delta h$ must be equal to 0, then from equation (5):

$$\frac{\Delta N + \Delta P}{\Delta P} = \frac{C}{C_r} \quad (6)$$

From the equation (6) it follows that the operating conditions of the proposed device can be adjusted by varying the ratio $C/C_r$, and the rigidity of the stand 4 without the rolls can be expressed as follows:

$$\frac{1}{C} = \frac{1}{C_h} + \frac{1}{C_{sg}} + \frac{1}{C_d} \quad (7)$$

where $C_h$ is the rigidity of the housing 7;

$C_{sg}$ is the rigidity of the screw-down gear;

$C_d$ is the rigidity of the hydraulic load cell 12 determined by the amount of fluid flowing in the closed system, chambers "B" of hydraulic cylinders 1 — hydraulic load cell 12, by the resilient properties of the fluid and by the area $F_1$.

Consequently, in accordance with the equations (6) and (7) a change in the amount of the fluid contained in the closed system "chambers "B" of hydraulic cylinders 1 — hydraulic load cell 12" will cause a change in the operating conditions of the device of the invention.

Given hereinbelow are examplary embodiments of the present invention. e.g.:

Each two-chamber hydraulic cylinder 22 (FIG. 3) is fitted with two rods 23 and 24. The rod 23 rests on the bottom separator 11 of the housing 7 of the stand 4. The other rod 24 accommodates a hydraulic load cell or dynamometer 25 which absorbs the pressure of the stand 4.

The chock 9 of the bottom roll 10 has openings 26 having bars 27 passed therethrough, said chock 9 resting on the hydraulic load cell 25. The bars 27 have one end thrust against the body of the hydraulic cylinder 22 and their opposite end thrust against the chock 2 of the top roll 3.

The chambers "A" of the double-space hydraulic cylinders 22 communicate with the pump-and-accumulator plant 14 through the pipe 13. A chamber of the hydraulic load cell 25 is in communication with the chamber "B" of the hydraulic cylinder 22 through drillings in the rods 23 and 24 of the hydraulic cylinder 22.

The chamber "B" of the hydraulic cylinder 22 is in turn in communication with the appliance 17 for varying the pressure within the chamber and communicates with the pump-and-accumulator plant 14 by means of the non-return valve 21.

According to said embodiment, the herein-proposed device is more compact and has no pipelines 15 interconnecting the hydraulic cylinders 22 and the hydraulic load cell 25, said pipelines 15 being in the first embodiment flexible or movable. Elimination of said pipelines 15 increases the dependability of the proposed device.

The bars 27 (FIG. 4) may thrust not against the chock but directly against the housing 7 and can be built up of several parts.

Said bars 27 can be extended into the chock openings or be located outside the chocks in the grooves of the housing 7.

The device, according to various particular embodiments, operates similarly to the above-outlined.

Thus the device according to the invention, assures automatic adjustment of a mill roll gap by directly placing in communication one of the chambers of the two-chamber hydraulic cylinders for prestressing said mill stand and the hydraulic load cell mounted under the chock of one of the rolls and being unaffected by said stand prestressing force, the other chamber of said two-chamber hydraulic cylinders communicating directly with the constant-pressure fluid source.

The herein-proposed device is characterized by simplicity of design and low manufacturing cost, uses a fluid with a purifying degree corresponding to that employed for conventional hydraulic drives, is simple to operate whereby it does not require highly-skilled attendants, and, finally, features a higher operating dependability.

What is claimed is:

1. A device for automatic adjustment of a roll gap in a mill stand, comprising: two-chamber hydraulic cylinders for prestressing said stand; hollow hydraulic dynamometers to absorb a roll force, said dynamometers being mounted under chocks of at least one of the rolls and not being affected by the action of said hydraulic cylinders, a chamber of each of said hydraulic dynamometers communicating directly with a first chamber of each said hydraulic cylinder; and a constant-pressure fluid source in communication directly with a second chamber of each said hydraulic cylinder.

2. A device as claimed in claim 1, wherein the chamber of said two-chamber hydraulic cylinder in communication with said chamber of said hydraulic dynamometer is made to communicate with means for varying the pressure within said spaces.

* * * * *